US006606751B1

(12) United States Patent
Kalhok et al.

(10) Patent No.: US 6,606,751 B1
(45) Date of Patent: Aug. 19, 2003

(54) HELMET

(75) Inventors: David Kalhok, Marion, IL (US); Pierre Rondeau, St-Denis de Brompton (CA); Martin Aubé, Sherbrooke (CA); Germain Cadotte, St-Elie d'Orford (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/586,616

(22) Filed: Jun. 2, 2000

Related U.S. Application Data

(63) Continuation of application No. PCT/CA98/01126, filed on Dec. 3, 1998.

(30) Foreign Application Priority Data

Dec. 3, 1997 (CA) ..... 2223345

(51) Int. Cl.[7] ..... A42G 1/08
(52) U.S. Cl. ..... 2/424; 2/6.5
(58) Field of Search ..... 128/205.27, 201.14, 128/201.24, 201.25, 206.21, 206.27, 206.28; 2/424, 6.3, 6.4, 6.5, 425

(56) References Cited

U.S. PATENT DOCUMENTS

| | | | | |
|---|---|---|---|---|
| 1,706,602 A | | 3/1929 | Drager | |
| 2,317,608 A | | 4/1943 | Heidbrink | |
| 2,348,277 A | | 5/1944 | Boothby et al. | |
| 2,867,812 A | | 1/1959 | Roth et al. | |
| 3,065,747 A | | 11/1962 | Forkel | |
| 3,110,034 A | | 11/1963 | Aileo | |
| 3,237,202 A | | 3/1966 | Aileo | |
| 3,239,843 A | | 3/1966 | Lobelle | |
| 3,310,811 A | | 3/1967 | Iacono, Jr. | |
| 3,351,056 A | * | 11/1967 | Durney | 128/201.14 |
| 3,400,407 A | | 9/1968 | Aileo | |
| 3,721,994 A | | 3/1973 | DeSimone et al. | |
| 3,768,100 A | | 10/1973 | Colman et al. | |
| 3,833,935 A | | 9/1974 | Ansite et al. | |
| 3,971,368 A | | 7/1976 | Forbes et al. | |
| 4,170,042 A | | 10/1979 | Aileo | |
| 4,195,328 A | | 3/1980 | Harris, Jr. | |
| 4,400,591 A | | 8/1983 | Jennings et al. | |
| 4,555,815 A | | 12/1985 | Walther | |
| 4,556,994 A | | 12/1985 | Kawasaki et al. | |

(List continued on next page.)

FOREIGN PATENT DOCUMENTS

| | | |
|---|---|---|
| CA | 2065300 | 8/1990 |
| DE | 28 46 636 | 4/1980 |
| DE | 44 16 921 | 11/1995 |
| EP | 0 371 858 A1 | 6/1990 |
| EP | 0 590 255 | 4/1994 |
| EP | 0 638 253 | 2/1995 |
| GB | 2 052 244 | 1/1981 |

OTHER PUBLICATIONS

Search Report for European Patent Application No. 01130658.6–2314, dated May 10, 2002.

*Primary Examiner*—Weilun Lo
*Assistant Examiner*—Joseph F. Weiss
(74) *Attorney, Agent, or Firm*—Pillsbury Winthrop LLP

(57) ABSTRACT

A breathing mask is provided for a helmet which reduces the formation of water on the lens of the eyeglasses of the wearer or on the shield of the helmet. The helmet comprises a head portion, a shield portion, and a breathing mask is hermetically adapted to the face of the wearer to evacuate the wear's breath outside the helmet through breathing channels. The jaw shield can be pivotally opened or closed and is locked to the head portion and includes a see-through shield and a tinted shield. The tinted shield can be lowered inside the helmet to protect the wearer from sun rays and reflexions.

17 Claims, 9 Drawing Sheets

U.S. PATENT DOCUMENTS 4,579,113 A 4/1986 McCreadie et al.
4,584,721 A 4/1986 Yamamoto
4,595,003 A 6/1986 Shoemaker et al.
4,598,430 A 7/1986 Nava
4,667,348 A * 5/1987 Sundahl ..... 2/410
4,676,236 A 6/1987 Piorkowski et al.
4,689,836 A 9/1987 Vitaloni
4,734,940 A 4/1988 Galet et al.
4,764,990 A 8/1988 Markert
4,803,980 A 2/1989 Nowakowski et al.
4,886,056 A 12/1989 Simpson
4,907,300 A 3/1990 Dampney et al.
D312,513 S 11/1990 Morin
5,003,632 A 4/1991 Claude
5,078,130 A 1/1992 Van Oosten et al.
5,093,939 A 3/1992 Noyerie et al.
H1039 H 4/1992 Tripp, Jr. et al.
D331,299 S 11/1992 Kamata
5,187,502 A 2/1993 Howell
D334,250 S 3/1993 Gallet
D340,545 S 10/1993 Kamata
D340,546 S 10/1993 Kamata
5,291,880 A 3/1994 Almovist et al.
D351,685 S 10/1994 Kamata
5,351,339 A 10/1994 Reuber et al.
5,394,566 A 3/1995 Hong
5,396,661 A 3/1995 Sutter et al.
D361,867 S 8/1995 Taniuchi
5,444,875 A 8/1995 Taniuchi
5,500,953 A 3/1996 Reuber et al.
5,538,001 A * 7/1996 Bridges ..... 128/206.24
5,549,104 A 8/1996 Crump et al.
5,555,569 A 9/1996 Lane
5,584,073 A 12/1996 Radzelovage et al.
5,603,317 A 2/1997 Farmer
5,619,755 A 4/1997 Casartelli
5,630,412 A 5/1997 Dubruille et al.
5,649,532 A * 7/1997 Griffiths ..... 128/206.24
5,653,225 A 8/1997 Schegerin
5,680,656 A * 10/1997 Gath ..... 2/424
5,694,650 A 12/1997 Hong
5,722,091 A 3/1998 Keller et al.
5,758,639 A * 6/1998 Ikonen ..... 128/201.25
5,765,235 A 6/1998 Arnold
5,794,260 A 8/1998 Schegerin
5,797,146 A 8/1998 Matich
5,901,369 A * 5/1999 Pilney ..... 2/6.5
5,910,764 A 6/1999 Hayden
D411,900 S 7/1999 Puleo
5,924,420 A 7/1999 Reischel et al.
5,930,843 A 8/1999 Kelly
D418,255 S 12/1999 Hohdorf
6,047,409 A 4/2000 Simpson
6,075,857 A 6/2000 Doss, Jr. et al.
6,085,358 A * 7/2000 Cogan ..... 2/424
6,161,225 A 12/2000 Arai
6,249,918 B1 * 6/2001 LaCroix ..... 2/424

* cited by examiner

HELMET

This application is a continuation of International Application No. PCT/CA98/01126, entitled "BREATHING MASK FOR A HELMET", filed on Dec. 3, 1998. The International Application claims priority to Canadian Patent Application No. 2,223,345, entitled "BREATHING MASK FOR A HELMET", which was filed on Dec. 3, 1997. Both of the above-referenced applications are incorporated herein by reference.

FIELD OF THE INVENTION

The invention relates to a breathing mask for a helmet which is particularly well suited for use when the temperature is below a certain point i.e. the point under which the breath of an operator condenses inside the helmet and causes the advent of water on the lens of the eyeglasses of the operator or on the shield of the helmet.

BACKGROUND OF THE INVENTION

A prior art helmet comprises a first part which protects the head of a wearer, as a conventional helmet; a second part, which is integrated with and forms a projection with the first part and protects the lower part of the face of the wearer, more particularly the jaw; and a shield, which is situated between an upper front section of the first part and an upper section of the second part to protect the face of the wearer.

Due to its structure, the helmet has a small interior chamber where the wearer can breath. This interior chamber is usually insulated from the atmosphere to protect the wearer from cold air. At a certain temperature, air which contains saturated particles of water will condense and create condensation. Because the temperature of the lens of the eyeglasses of the operator wearing the helmet or the shield of the helmet can reach the condensation point of the breath of the wearer, water will form on the eyeglass lens or on the shield.

In order to avoid the problem of condensation, it is possible to open the shield to allow outside air to flow into the helmet until condensation is eliminated. This however presents a problem in that the wearer may be exposed to cold air which is uncomfortable and may be dangerous to health. Furthermore, the wearer has to use one hand to open the shield which may be hazardous when he or she is steering the vehicle being driven. The shield could also involuntarily close by impact or sudden movement. Thus, there is a need to provide a device which is capable of avoiding or eliminating the condensation created inside a full face helmet.

A prior art helmet provides some protection against sun rays. However, the shield of a prior art helmet is either clear or tinted and no adjustment of the tint is possible. On a bright sunny day, the wearer of a prior art helmet must also wear tinted eyeglasses to protect himself against the intensity of light if the shield of his helmet is clear. In changing weather conditions, the wearer may have to put the tinted eyeglasses on and off as the intensity of light changes. Thus, there is also a need to provide a helmet adapted to adjust the protection of the eyes of the wearer from sun rays.

OBJECTS AND STATEMENT OF THE INVENTION

It is an object of the present invention to provide a breathing mask for a helmet which reduces the formation of water on the lens of eyeglasses or the shield of the helmet.

It is an object of the present invention to provide a helmet that overcomes or at least reduces the deficiencies associated with a prior art helmet.

It is another object of the present invention to provide a helmet comprising a breathing mask which reduces the formation of water on the lens of eyeglasses or the shield of the helmet.

A further object of the invention is to provide a helmet including a tinted inner shield which is adapted to adjust the protection of the eyes of the wearer from sun rays as he or she requires.

As embodied and broadly described herein, the invention provides a breathing mask adapted to fit the contours of the face of a wearer, said breathing mask adapted to be mounted to a helmet, said breathing mask comprising at least one breathing channel through which air may circulate and a binding member; said at least one breathing channel adaptable to said helmet and said binding member adapted to connect and secure said breathing mask to said helmet, and to position said breathing mask in relation to said face.

As embodied and broadly described herein, the invention provides a helmet adapted to receive and retain a breathing mask, said helmet comprising:

a head portion;

a jaw shield mounted to said head portion, said jaw shield including at least one passage adapted to receive an exterior end of said breathing channel, a binding member adapted to secure said breathing mask to said helmet, whereby the breathing mask is substantially hermetically adapted to the face of the wearer and the breath of the wearer may be expelled from inside said jaw shield.

In a preferred embodiment of the present invention the novel helmet comprises a head portion adapted to protect the head of the operator, a shield portion comprising a jaw shield adapted to protect the lower portion of the face of the wearer or operator; the shield portion being mounted to the head portion and adapted to move from an open position to a closed position and an optional latching mechanism which locks the jaw shield of the shield portion to the head portion. The optional latching mechanism is actuated with two lever buttons located at the front of the jaw shield and sufficiently close to one another so that one hand can actuate both buttons and in the same movement pull the jaw shield from the closed position to the open position. The jaw shield has passages that are connected, when the jaw shield is in the closed position, to a breathing mask through flexible tubes thereby linking the breathing mask to the outside through which the wearer may breath and the moisture content of his or her expelled breath can circulate and be evacuated. This arrangement prevents or at least greatly reduces condensation and fogging of the eye shield of the shield portion and of the eyeglasses of the wearer.

The breathing mask comprises a mask body, surrounding the nose and mouth of the wearer and including a port on each side adjacent the mouth; a flexible tube which connects said port to said passage when said face portion is in the closed position, a binding member adapted to secure said breathing mask to said helmet, and resilient straps.

The binding member connects said breathing mask to the helmet, wherein said breathing mask is substantially hermetically adapted to the face of the wearer and the breath is restricted from entering the inside chamber. The binding member is preferably a snap-holder located at one end of the flexible tubes. The binding member may also be a hook and loop (velcro) device, a clip or a strap; all these elements being capable of connecting and securing the breathing mask to the head portion of the helmet.

Advantageously, the shield portion further comprises an eye shield including a see-through shield and a tinted shield;

said tinted shield being movable from a first position to a second position, said tinted shield adapted, in said first position, to be housed and partially hidden inside an upper chamber, and in said second position, to be in front of the eyes of the wearer whereby said tinted shield protects the eyes of the wearer from intense light. The tinted shield includes a lever protruding from a narrow slot of the upper chamber, this lever is adapted to maneuver said tinted shield from said first position to said second position.

As embodied and broadly described herein, the invention also provides a filter for a breathing mask comprising a thin layer of material adapted to isolates the skin of a wearer from said breathing mask, said layer of material shaped to fit a given contour of said breathing mask.

Another object of the invention is to provide a filter adapted to be positioned between the mask body and the face of the wearer whereby said filter isolates the skin of the wearer from the breathing mask. Advantageously, the filter is a supple thin cloth of felt-like material.

As embodied and broadly described herein, the invention also provides a breathing mask kit comprising:

- a mask body adapted to fit the contours of the face of a wearer, said mask body including at least one port;
- at least one hollow flexible tube including an interior end and an exterior end;
- a binding member including an aperture; said binding member adapted to secure said breathing mask to a helmet and to align said aperture with a passage on said helmet;
- said interior end being adapted to engage said at least one port of said mask body and said exterior end being adapted to engage said aperture of said binding member whereby when said at least one hollow flexible tube is engaged to said at least one port of said mask body and to said aperture of said binding member, said at least one hollow flexible tube acts as a conduit through which the breath of a wearer may circulate.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which:

FIG. 6 is a side elevational view of a full face helmet in an open position worn by a wearer with the breathing mask put on;

Figure 1:
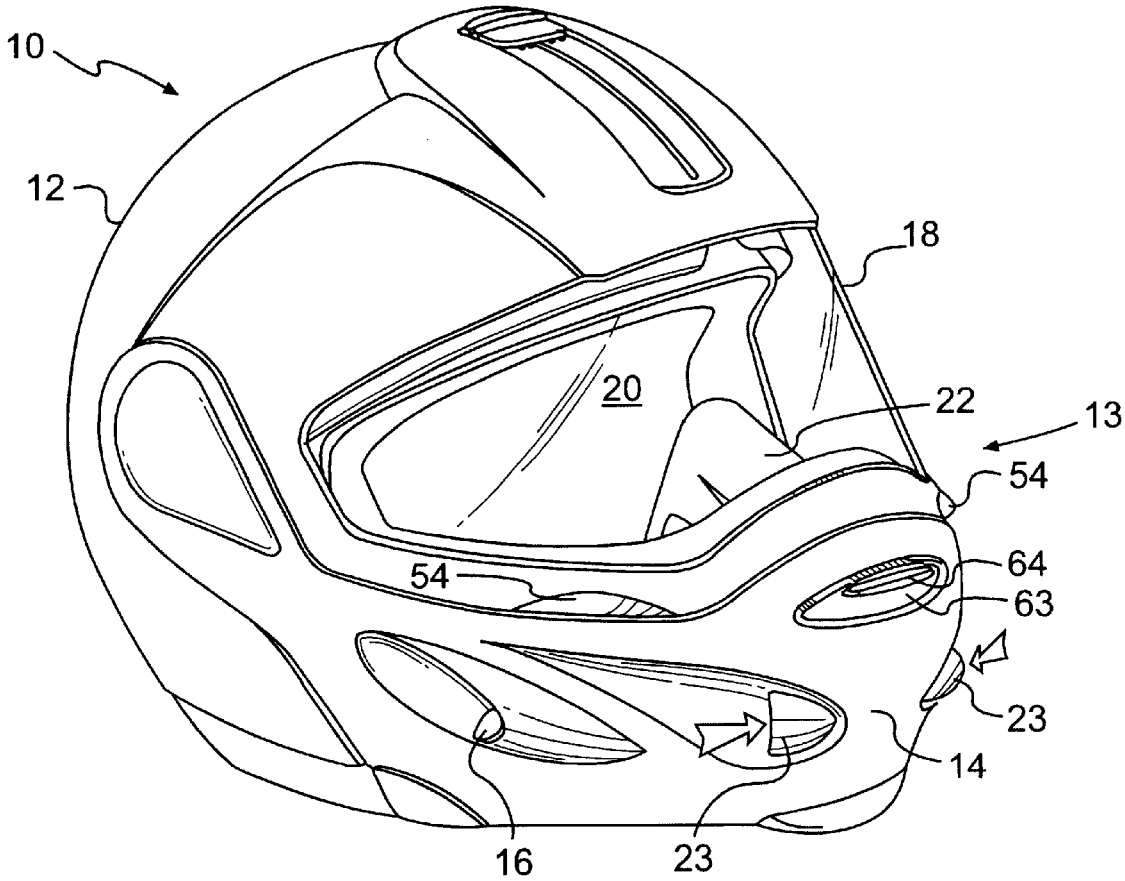
FIG. 1 is a perspective view of a full face helmet constructed in accordance with the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

Figure 2:
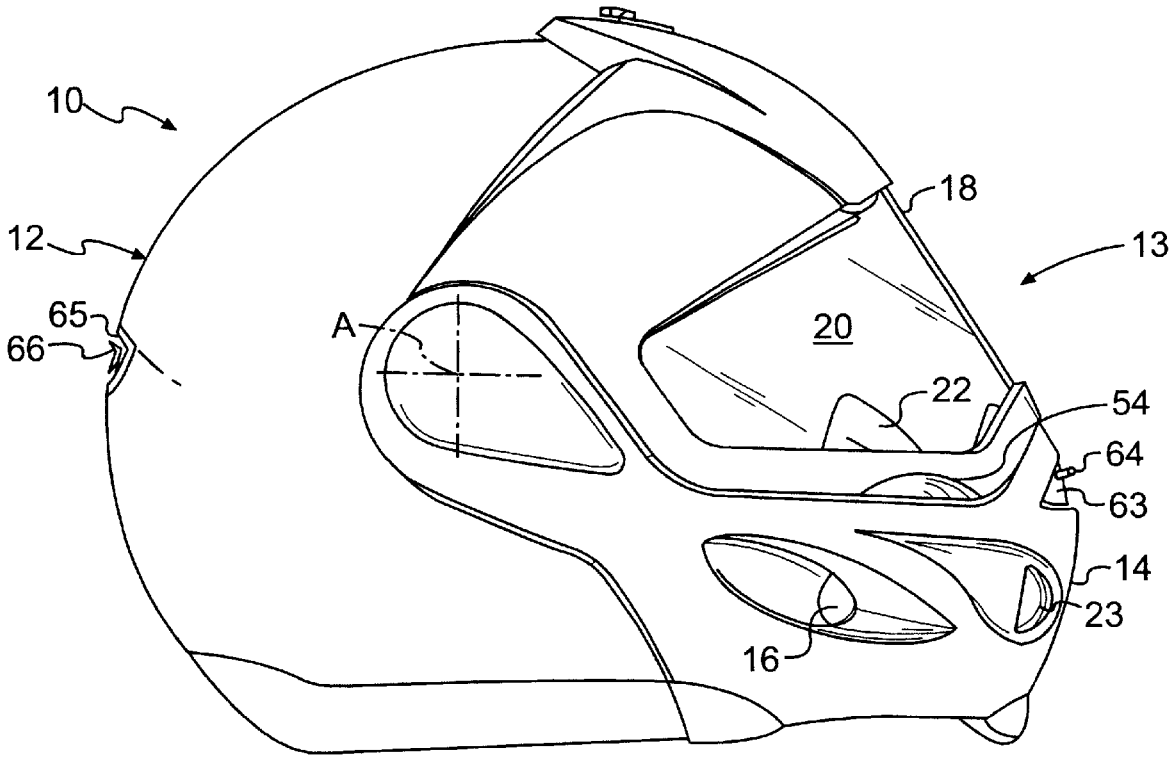
FIG. 2 is a side elevational view of a full face helmet constructed in accordance with the invention.

Referring now to the drawings, FIGS. 1 and 2 illustrate the novel helmet which is generally designated by the reference number 10. The helmet 10 comprises a head portion 12, a shield portion 13 pivoting about axis A, and having a pair of passages 16 through which the breath of a wearer may circulate, a see-through shield 18, an inside chamber 20, a breathing mask 22, and a pair of lever buttons 23 located at the front of the a shield portion 13. The shield portion 13 comprises a jaw shield 14 pivotally connected to the head portion 12, pivoting about axis A, and having a pair of passages 16 through which the breath of a wearer may circulate and an eye shield 52 that has a see-through shield 18.

Figure 3:
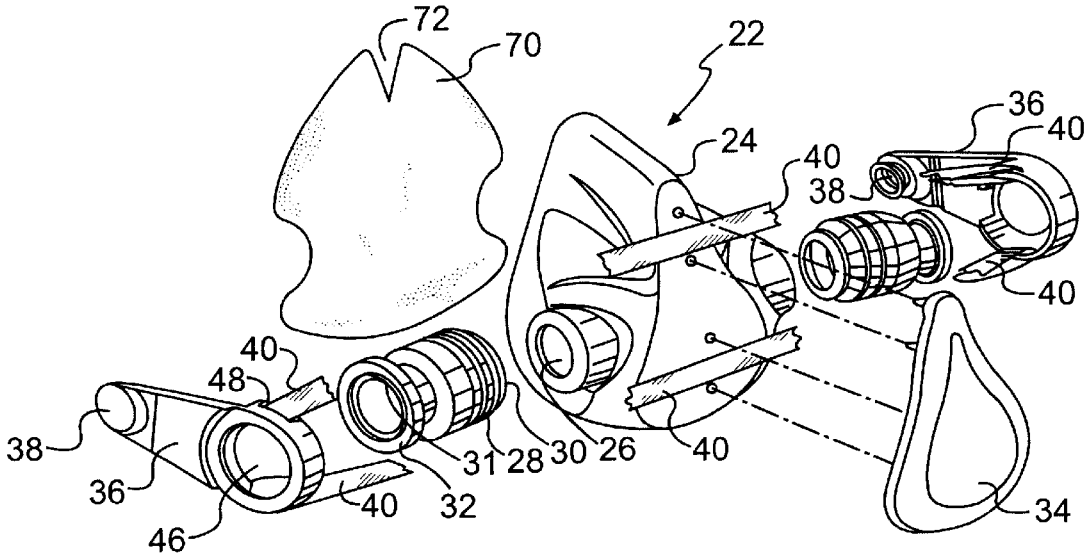
FIG. 3 is a perspective exploded view of a breathing mask constructed in accordance with the invention.
Figure 4:
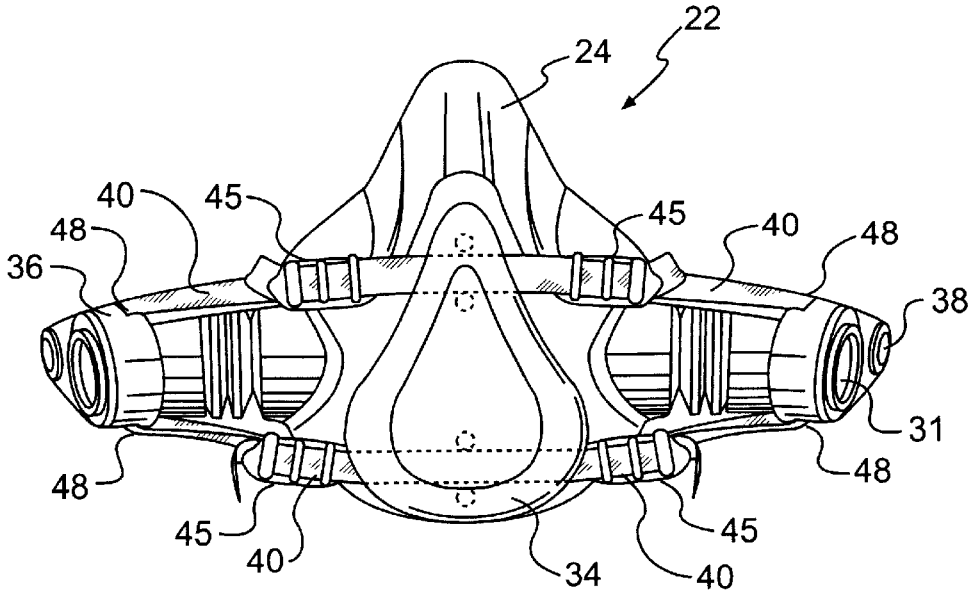
FIG. 4 is a front elevational view of the breathing mask constructed in accordance with the invention.

With reference to FIGS. 3 and 4, the breathing mask 22 comprises a mask body 24 preferably made of a supple material so as to embrace the contours of the face. The mask body 24 preferably features a port 26 on both sides, adjacent to the mouth of the wearer. Flexible tubes 28 are provided to connect the ports 26 to the passages 16 of the jaw shield 14 (FIGS. 1 and 2). As can be seen in FIG. 3, the flexible tube 28 has an interior end 30 and an exterior end 32. The interior end 30 is adapted to be engaged into port 26 and the exterior end 32 is adapted to be hermetically connected with the passage 16. The flexible tube 28 is assembled to the mask body 24 by inserting the last rib of the interior end 30 into port 26. The exterior end 32 is inserted through the aperture 46 of the snap-holder 36 so that the exterior end 32 protrudes through the aperture 46 of snap-holder 36. The exterior end 32 is provided with an annular lip 31 in order to create an hermetic seal with the passage 16 of the jaw shield 14 when these two components (32 and 16) are aligned. The flexible tube 28 is also preferably made of a supple material and features an array of ribs enabling the flexible tube 28 to assume various lengths for ease of assembly and to provide freedom of movement when the breathing mask 22 is put on or taken off. The flexible tubes 28 are of course hollow to provide adequate circulation of air.

A filter 70 adapted to fit inside the breathing mask 22 is provided optionally to isolate the skin of the wearer from the mask body 24. The filter 70 is a supple thin layer of material like a cloth or a felt, adapted to permit airflow while stopping dust particles. The material is preferably soft so as not to irritate the skin of the wearer. The filter 70 is positioned inside the mask body 24 before the breathing mask 22 is put on. It may be discarded after use and replaced by a new one or it may be re-used as often as one wishes. The filter 70 features a opening 72, for example a V-shaped opening, which facilitates the installation of the filter 70 into the mask body 24 and prevents folding of the filter 70 when positioned over the nose of the wearer. Folding of the filter 70 could allow the breath to escape into the inside chamber 20. Advantageously, the filter 70 protects the skin of the wearer from possible irritation when the breathing mask 22 is worn for a extended period of time. This filter 70 also serves as an hygienic device if the full face helmet 10 is to be used by more than one person.

A frontal cover 34 is mounted to the front portion of the mask body 24 in order to hold and maintain in position, a pair of resilient straps 40. The resilient straps 40 are engaged at each end, to slender apertures 48 of the snap-holders 36. The resilient straps 40 are provided to adjust the length of each flexible tubes 28 thereby adjusting the distance between the mask body 24 and the snap-holders 36. The adjustment is achieved by setting the length of the resilient straps 40 using standard buckles 45. From FIG. 3, it can be seen that snap-holders 36 are elongated components featuring at one end, a substantially circular aperture 46, a pair of slender apertures 48 and at the other end, a snap button 38.

Figure 5:
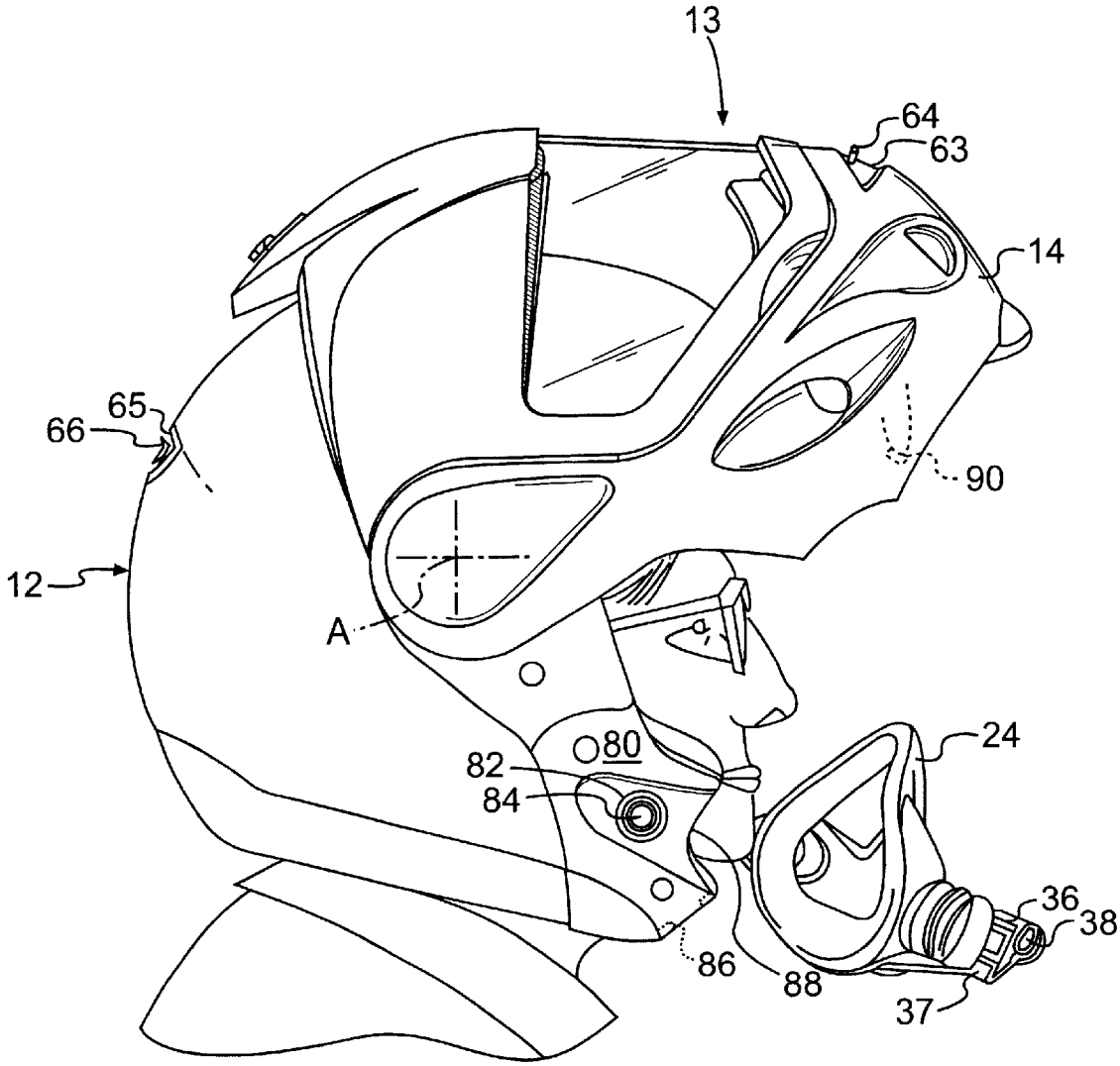
FIG. 5 is a side elevational view of the full face helmet showing the full face helmet in an open position worn by a wearer with the breathing mask partially removed.
Figure 7:
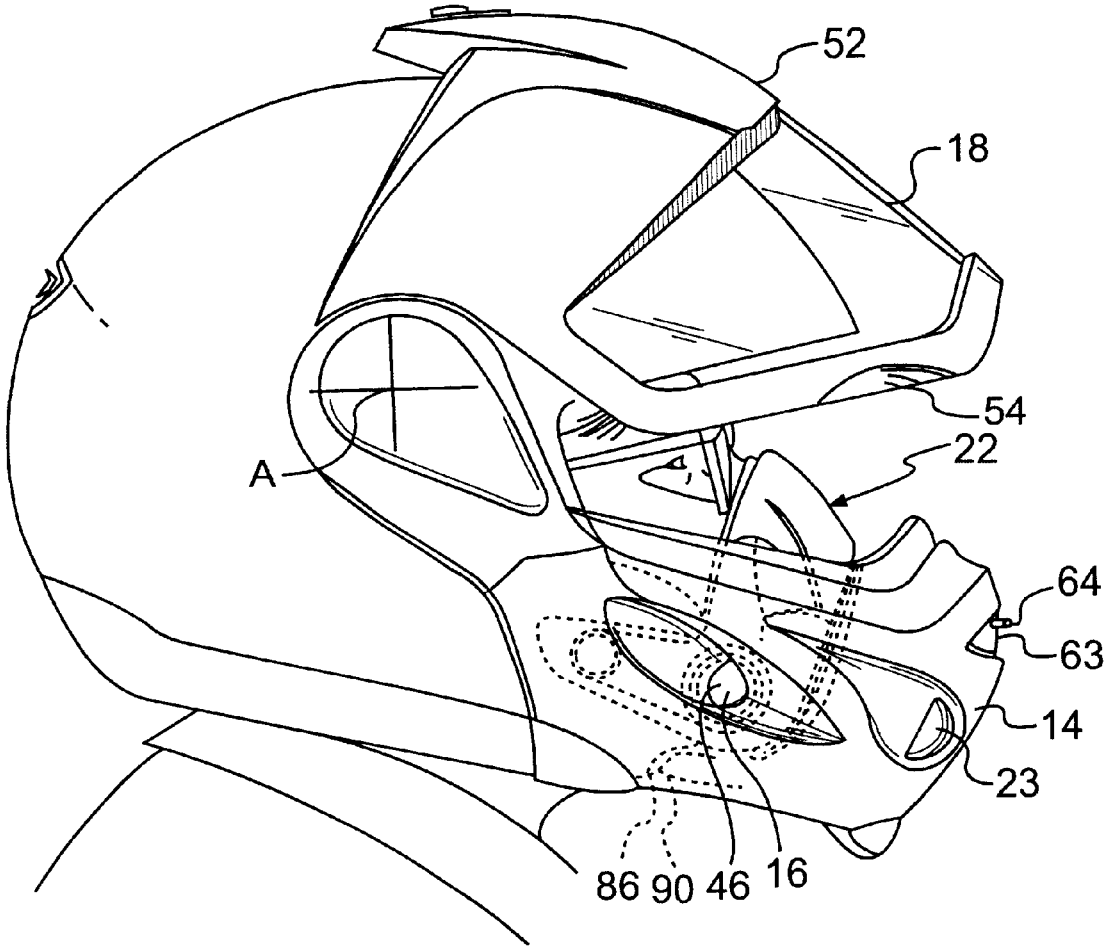
FIG. 7 is a side elevational view of a full face helmet worn by a wearer with the jaw shield lowered into the closed position and the eye shield in the open position.

Referring to FIG. 5, the head portion 12 comprises a pair of side covers 80 fastened to the side of the head portion 12 featuring an aperture 82 which opens onto a snap 84 on which the snap button 38 of the snap-holder 36 will be engaged. The side covers 39 features a second aperture 86 shown in dotted lines configured to receive an optional latching mechanism 90 also shown in dotted lines which locks the jaw shield 14 to the head portion 12 when the jaw shield 14 is in the closed position. Each of the side covers 39 has a curved section 88 provided to fit the circular contour 37 of the snap-holder 36. The combination of configuration of the circular contour 37 of the snap-holders 36 and of the curved section 88 of the side covers 39 enables proper positioning of the snap-holders 36 in relation to the head portion 12, to the jaw shield 14 and more specifically, to the passages 16 when the jaw shield 14 is in the closed position. FIG. 7 shows how the passage 16 and the circular aperture 46 of the snap-holders 36 are aligned when the jaw shield 14 is in the closed position.

Figure 6:
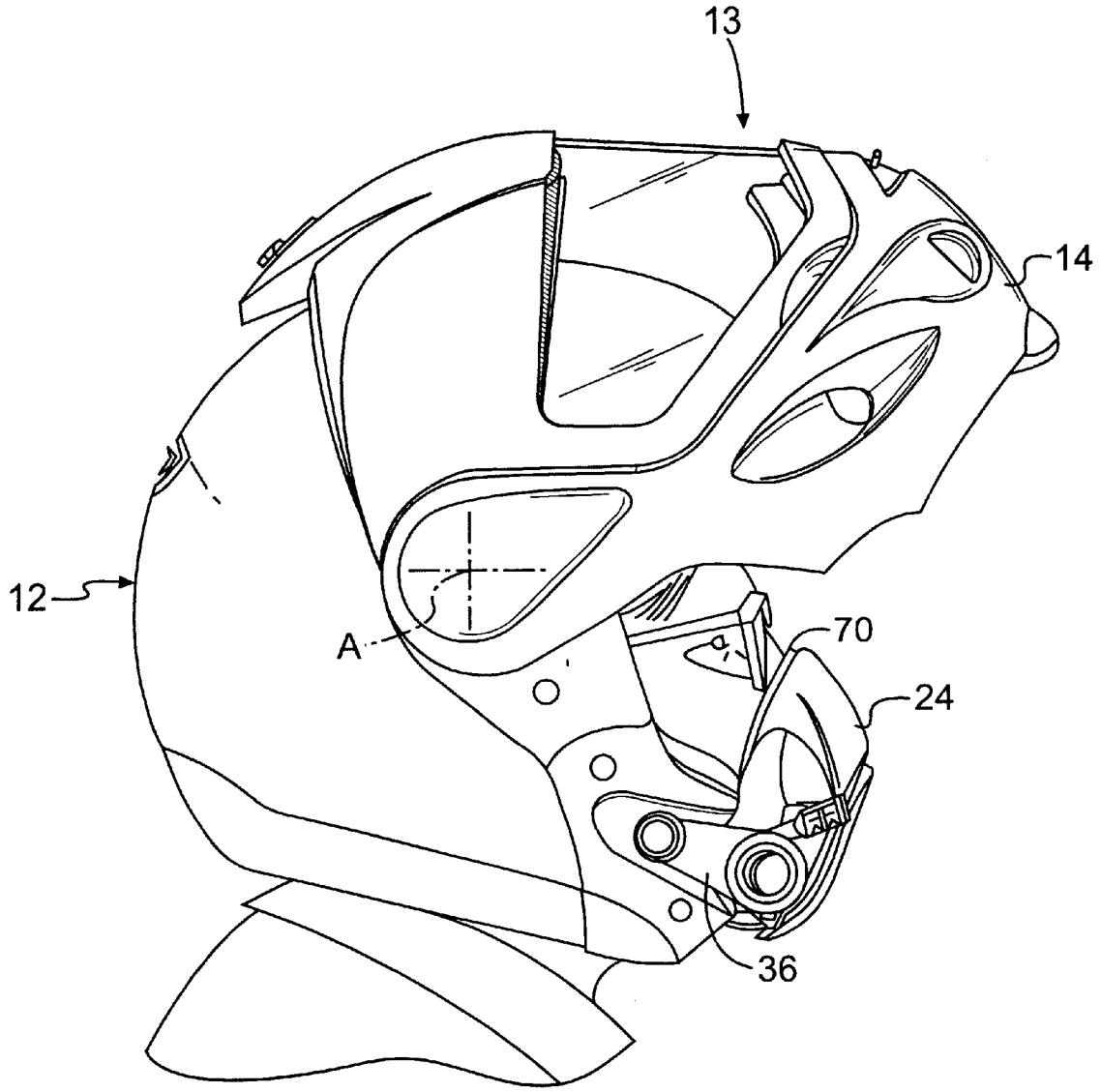

To put the full face helmet 10 on with the breathing mask 22, the wearer must have the jaw shield 14 in the opened position. As shown in FIG. 5, the wearer first attaches one of the snap-holders 36 to the head portion 12 and then puts the head portion 12 over his or her head. The filter 70 previously described may be positioned inside the mask body 24 before the breathing mask 22 is put on. Advantageously, the filter 70 protects the skin of the wearer from possible irritation when the breathing mask 22 is worn for a extended period of time. Once the filter is positioned inside the breathing mask 22, the wearer then puts the breathing mask 22 over his mouth and nose and engages the remaining snap-holder 36 to the other side of the head portion 12 as shown in FIG. 6. FIG. 6 also shows the filter 70 installed thereby isolating the skin of the wearer from the mask body 24 and preventing any direct contact between the skin and the mask body 24.

Referring to FIG. 7, once the breathing mask 22 is installed, the wearer can lower the jaw shield 14. In the fully closed position, the optional latching mechanism 90 located on both sides of the jaw shield 14 engages the aperture 86 of the side covers 39 thereby locking the jaw shield 14 onto the head portion 12 and preventing the jaw shield 14 from unduly opening because of a wind gust or from an impact at which time, it is critical that the jaw shield 14 remains properly positioned in order to efficiently protect the wearer. The locking mechanism 90 may be disengaged by simply pressing simultaneously the two lever buttons 23 located at the front of the jaw shield 14. The two lever buttons 23 are actuated by pressing them in the direction illustrated by the arrows in FIG. 8. Advantageously, the lever buttons 23 are positioned close enough to each other so that they can be actuated with a single hand. This feature is very useful at times when the wearer wishes to raise the jaw shield 14 while driving a vehicle. It could be dangerous to let go of the steering even for a short period of time. This feature allows him or her to keep one hand on the steering while raising the jaw shield 14. Moreover, once the two lever buttons 23 are pressed and the latching mechanism 90 is disengaged, the same two lever buttons 23 serve as gripping elements enabling the hand to apply the necessary force to raise the jaw shield 14.

Figure 9:
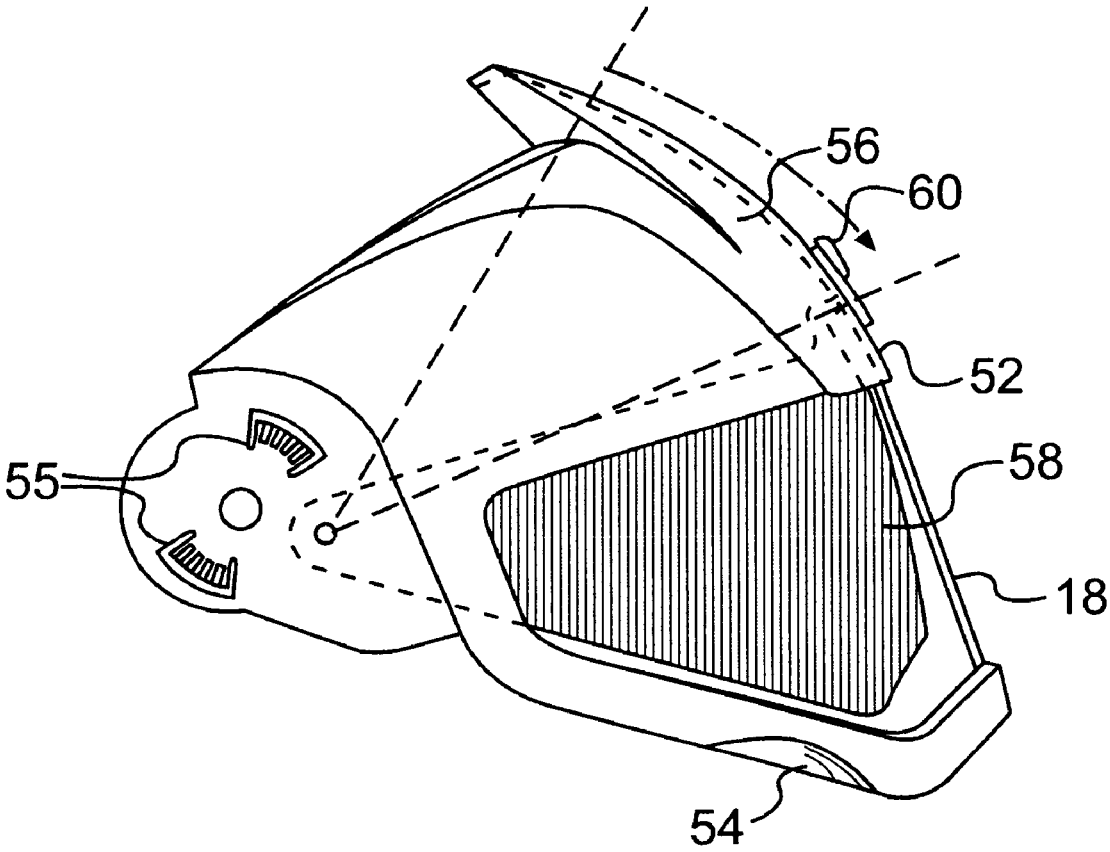
FIG. 9 is a side elevational view of the eye shield removed from the full face helmet.

As shown in FIG. 7, the wearer may also choose to keep the jaw shield 14 in the closed position and instead, raise the eye shield 52 which is pivotally mounted to the jaw shield 14. The eye shield 52 comprises the see-through shield 18 and two small handle grips 54 located at the bottom of the eye shield 52 which enable the wearer to take hold of the eye shield 52 in order to raise it. Referring to FIG. 9, the eye shield 52 advantageously features a jagged surface 55 surrounding the pivoting points which enable the eye shield 52 to be partially opened and remain in a partially opened position due to the added friction provided by the jagged surface 55.

Figure 8:
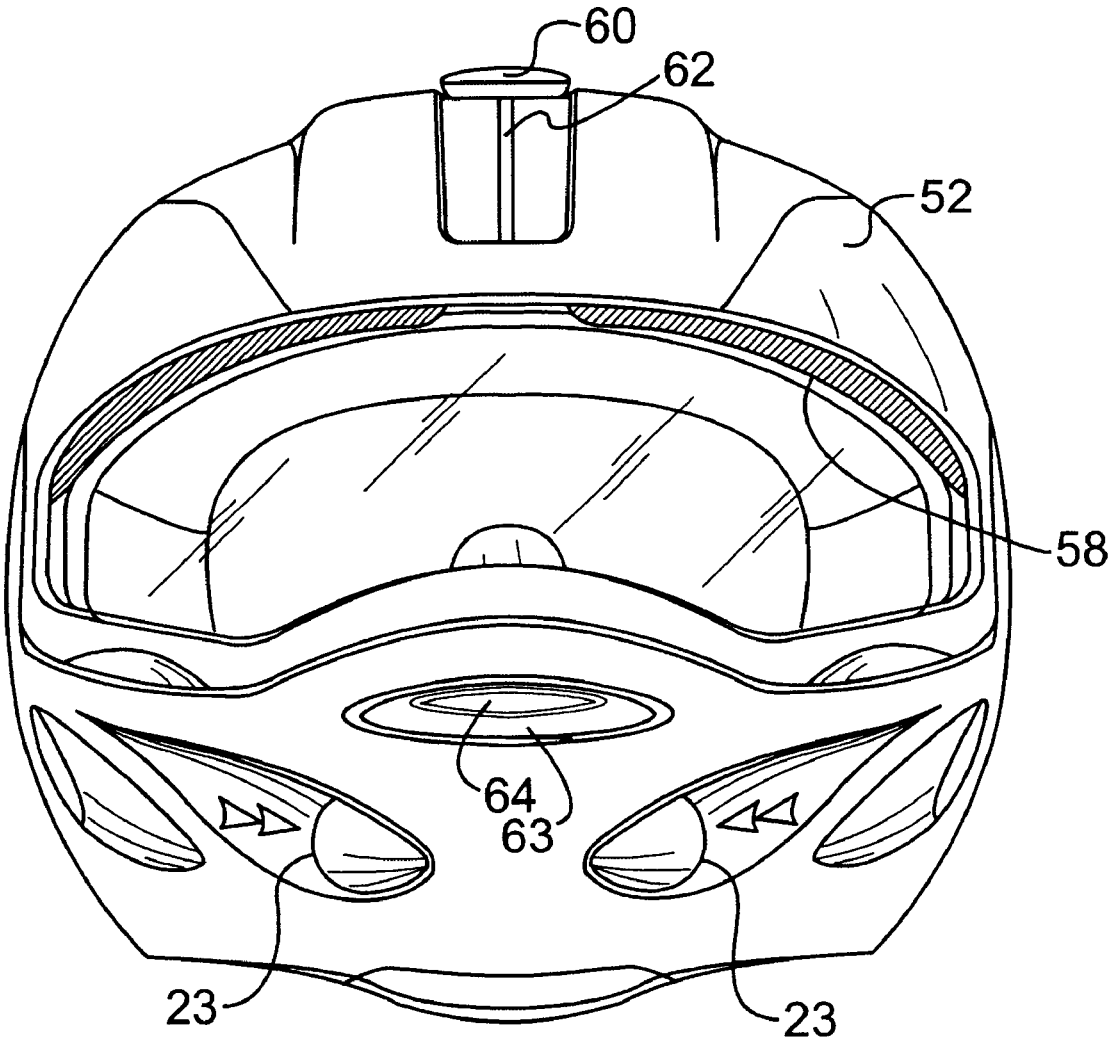
FIG. 8 is a front elevational view of the full face helmet constructed in accordance with the invention.
Figure 10:
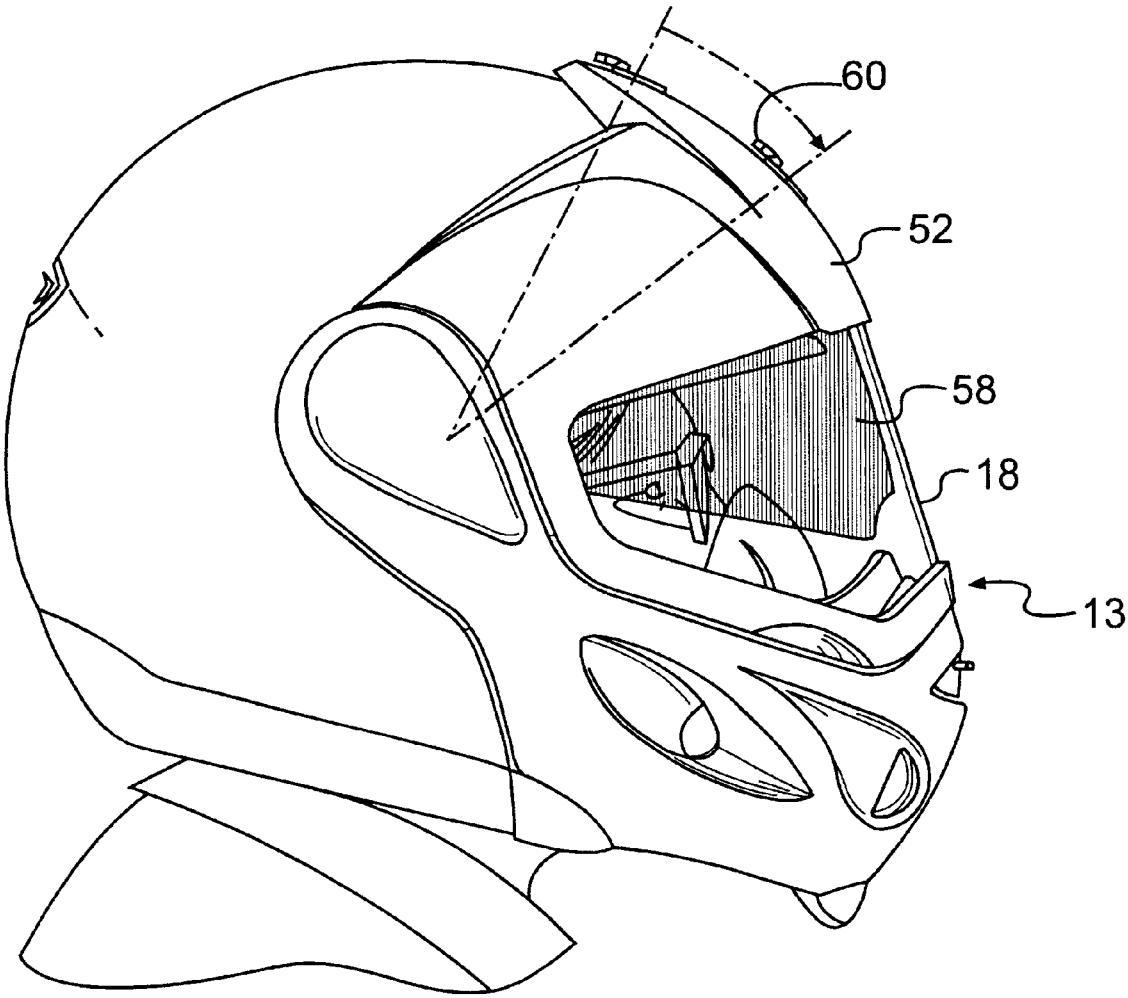
FIG. 10 is a side elevational view of the full face helmet showing the motion of the tinted shield.

Referring now to FIGS. 9 and 10, the eye shield 52 also advantageously comprises an upper chamber 56 in which a tinted shield 58 is housed and adapted to be raised or lowered with a lever 60 guided by a narrow slot 62 (FIG. 8). The tinted shield 58 is pivotally mounted to the eye shield 52 as the dotted lines in FIG. 9 show. The tinted shield 58 is an integral part of eye shield 52; if the eye shield 52 is raised or lowered, the tinted shield 58 will follow the motion. The tinted shield 58 is provided to protect the eyes of the wearer from sun rays or reflexions. The tinted shield 58, in the closed position, is hidden away inside upper chamber 56. To lower the tinted shield 58, the wearer simply has to grip the lever 60 and pull it downward in order for the tinted shield 58 to come over the eyes of the wearer as shown by the dash-dot-dash arrows of FIGS. 9 and 10. The tinted shield 58 comes down inside the full face helmet 10 providing an excellent protection against sun rays. The tinted shield 58 thereby allows a practical adjustment means for protecting the eyes of the wearer against sun rays or bright reflexions. Because it is never in contact with the exterior elements, the tinted shield 58 is protected and remains almost always clean and free of scratches.

Referring back to FIGS. 1 and 2, the full face helmet 10 also includes an air entry 63 located at the front of the jaw shield 14 that can be controlled by a gate 64 to permit or restrict air flow into the inside chamber 20 of the full face helmet 10. Another air passage 65 is provided at the back of the full face helmet 10 also featuring a gate 66 to permit or restrict air flow into the full face helmet 10.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A helmet comprising:

a head portion;

a jaw shield connected to the head portion and adapted to extend below a chin of a wearer;

an eye shield movably connected to the head portion, the eye shield comprising a see-through shield and an upper chamber, the eye shield having open and closed positions relative to the head portion; and a tinted shield movably connected to the head portion and positioned inwardly of an external surface of the eye shield, the tinted shield comprising a lever protruding through a narrow slot in the upper chamber of the eye shield, the tinted shield having raised and lowered positions relative to the head portion and being movable relative to the eye shield, the lever being adapted to maneuver the tinted shield between the raised and lowered positions such that the lever and tinted shield move in unison, wherein the tinted shield is adapted to be in front of the wearer's eyes when in the lowered position and is adapted to be at least substantially out of the wearer's field of vision when in the raised position.

2. The helmet of claim 1, wherein the eye shield is connected to the head portion indirectly via a connection to the jaw shield.

3. The helmet of claim 1, wherein the jaw shield is connected to the head portion indirectly via a connection to the eye shield.

4. The helmet of claim 1, wherein the eye shield is pivotally connected to the head portion.

5. The helmet of claim 4, wherein the tinted shield when in the raised position is at least partially housed between the external surface of the eye shield and the head portion.

6. The helmet of claim 4, wherein the lever is connected directly to the tinted shield through the narrow slot to maneuver the tinted shield between the raised and lowered positions.

7. The helmet of claim 4, wherein the tinted shield is connected to the head portion via a connection of the tinted shield to the eye shield.

8. The helmet of claim 7, wherein the tinted shield is pivotally connected to the eye shield.

9. The helmet of claim 8, wherein the jaw shield is movably connected to the head portion, the jaw shield having open and closed positions relative to the head portion, the jaw shield being adapted to extend below the chin of the wearer when in the closed position.

10. The helmet of claim 8, wherein an axis of rotation of the tinted shield relative to the eye shield is distinct from an axis of rotation of the eye shield relative to the head portion.

11. The helmet of claim 8, wherein the tinted shield when in the raised position is at least partially housed between the external surface of the eye shield and the head portion.

12. The helmet of claim 11, wherein the lever is connected directly to the tinted shield through the narrow slot to maneuver the tinted shield between the raised and lowered positions.

13. The helmet of claim 4, wherein the tinted shield is pivotally mounted to the eye shield.

14. The helmet of claim 13, wherein an axis of rotation of the tinted shield relative to the eye shield is distinct from an axis of rotation of the eye shield relative to the head portion.

15. The helmet of claim 13, wherein the jaw shield is movably connected to the head portion, the jaw shield having open and closed positions relative to the head portion, the jaw shield being adapted to extend below the chin of the wearer when in the closed position.

16. The helmet of claim 13, wherein the tinted shield is at least partially housed between the head portion and the external surface of the eye shield when in the raised position.

17. The helmet of claim 16, wherein the tinted shield includes a lever protruding through a narrow slot in the eye shield, the lever adapted to maneuver the tinted shield between the raised and lowered positions.

* * * * *